US006824031B2

(12) United States Patent
McKenzie

(10) Patent No.: US 6,824,031 B2
(45) Date of Patent: Nov. 30, 2004

(54) PAPER TOWEL HARNESS

(75) Inventor: Rebecca McKenzie, Glenwood Springs, CO (US)

(73) Assignee: Rebecca Anne McKenzie, Glenwood Springs, CO (US)

( * ) Notice: Subject to any disclaimer, the term of this patent is extended or adjusted under 35 U.S.C. 154(b) by 7 days.

(21) Appl. No.: 10/151,375

(22) Filed: May 20, 2002

(65) Prior Publication Data

US 2003/0213828 A1 Nov. 20, 2003

(51) Int. Cl.[7] ..... B65D 85/672; A45F 3/00

(52) U.S. Cl. ..... 224/666; 224/669; 224/677; 224/270; 224/271; 242/588.1; 242/586

(58) Field of Search ..... 224/665–675, 224/162, 269, 270, 271, 677; 206/390, 412; 15/210.1; 242/588.1, 598, 598.3, 298.5, 296.8, 136, 404, 404.1, 404.2, 404.3, 586

(56) References Cited

U.S. PATENT DOCUMENTS 462,310 A * 11/1891 Gardner ..... 242/598.5
1,069,108 A * 8/1913 Buhl ..... 242/588.1
1,092,792 A * 4/1914 Hemstreet ..... 224/677
1,554,082 A * 9/1925 Gerould ..... 242/588.1
1,704,614 A * 3/1929 Johnston ..... 242/598.4
3,258,220 A * 6/1966 Munger ..... 242/404.1
3,721,395 A * 3/1973 Snipes ..... 242/596.8
4,390,096 A * 6/1983 Goldenberg ..... 206/390
4,609,485 A * 9/1986 Kitano et al. ..... 252/299.61
4,896,806 A * 1/1990 Sanchez, Jr. ..... 224/673
5,941,438 A * 8/1999 Price ..... 224/665
6,173,839 B1 * 1/2001 Dieter et al. ..... 206/542
6,216,920 B1 4/2001 Baggett
6,216,978 B1 * 4/2001 Rodriguez ..... 242/588.1
6,267,316 B1 7/2001 Cross

* cited by examiner

*Primary Examiner*—Nathan J. Newhouse

(57) ABSTRACT

A portable paper towel dispenser to be worn on the waist of the user for the purpose of having a constant access too a roll of paper towels when cleaning. An adjustable belt assembly supports a detachable dowel system which bears a roll of paper towels and a detachable tension mechanism to retard unraveling. The harness belt strap adjusts to present the paper towels in front, back or to the side of the user's body. The harness belt appendages adjust to raise or lower the angle of the paper towel roll.

17 Claims, 3 Drawing Sheets

PAPER TOWEL HARNESS

BACKGROUND

1. Field of Invention

This invention relates to paper towel holders, specifically a portable paper towel dispenser designed to be worn on the person of the user for the purpose of providing constant access to a roll of paper towels.

2. Description of Prior Art

Paper towel holders are traditionally mounted to flat, stationary surfaces such as walls, cabinets etc. Paper towel holders are usually installed within a work area where they are the most utilized. When needed in other areas, the user will typically tear off a number of sheets as anticipated for the task at hand. Or if the cleaning or drying task is extensive, one typically procures a new roll of paper towels and carries it to the cleaning area.

Because a roll of paper towels is cumbersome and unwieldy, it is usually carried separately from other cleaning supplies. It is often misplaced or left behind when the user moves on to another cleaning task. Time and motion are often wasted by the effort expended by just trying to keep track of a loose roll of paper towels.

The paper towel is an indispensable item to the professional cleaning person, as well as to most home-makers. Accordingly, there is a need for a device that provides continual access to paper towels whenever or wherever they are needed.

OBJECTS AND ADVANTAGES

In accordance with the preferred embodiment of the present invention, a portable paper towel dispensing device is disclosed. Several advantages of my present invention are:

(a) to provide continual access to a source of paper towels when cleaning.

(b) to provide a convenient transport of a roll of paper towels while moving to and from, or around a cleaning area.

(c) to provide an efficient means of dispensing the exact amount of paper towels as needed, when needed.

(d) to provide an awareness of the whereabouts of the paper towels at all times.

My paper towel harness has been developed for the purpose of having constant access to a roll of paper towels when cleaning. The paper towel harness is convenient to wear and use for any cleaning task. My invention comprises an adjustable belt with a harness configuration attached to it. The harness supports a dowel which bears a single roll of paper towels. The belt is worn, loosely around the waist allowing the harness to be easily shifted to the front, side or back of the user's body. Thus, the paper towels are conveniently worn out of the way, in back when not in use. And the towels are easily slid to the front or either side of the body for ready access when needed. The harness apendages that support the dowel can also be adjusted to raise or lower the roll of paper towels. This feature permits the towels to be dispensed with the dowel parallel or angled as desired.

My paper towel harness is light-weight and comfortable to wear. The homemaker will find this device to be a convenience that makes house-maintenance easier. And for the professional cleaning person, my invention can effectively affect the bottom line. Saved time and motion mean increased productivity and profit.

DRAWING FIGURES

In the drawings, closely related figures have the same number but different alphabetic suffixes.

REFERENCE NUMERALS IN DRAWINGS

Figure 1A:
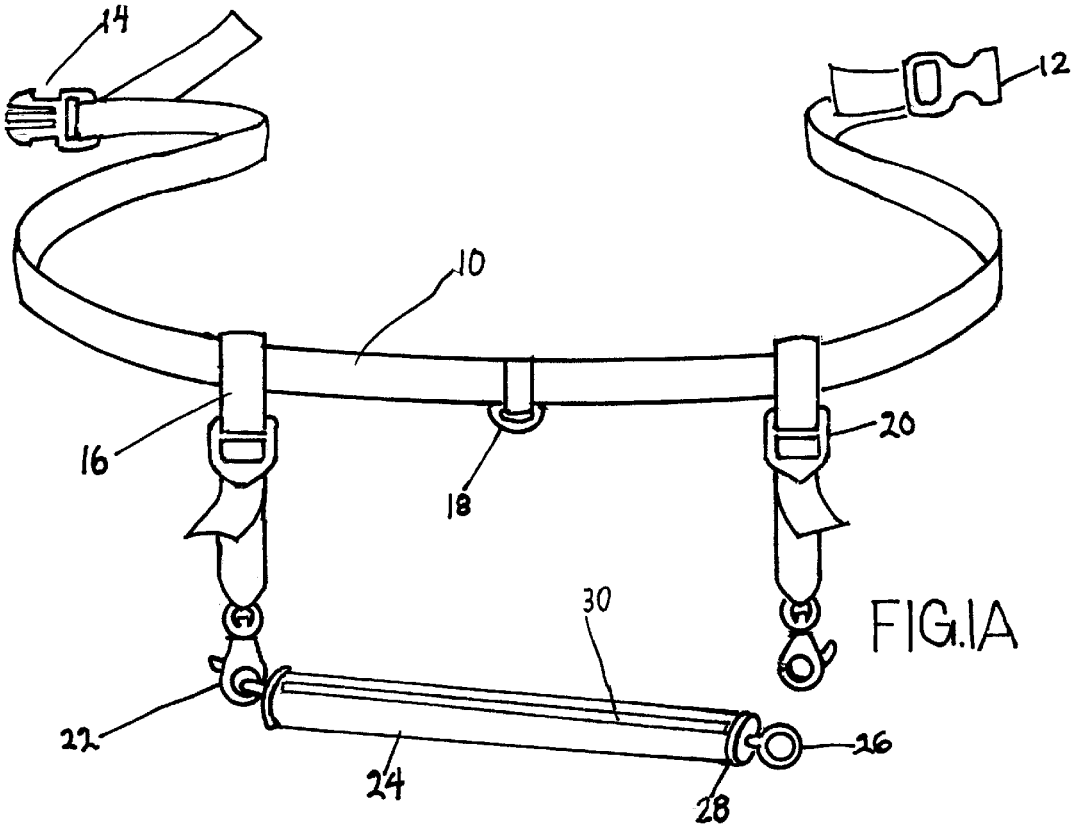
FIGS. 1A to 1B show various aspects of a basic paper towel harness construction and its parts.

10 belt strap
12 belt buckle
14 belt tension lock
16 belt appendage strap
18 D-ring
20 tension lock
22 bolt snap
24 dowel
26 eye screw
28 fender washer
30 friction strip
32 tension tube
34 upper shock cord
36 lower shock cord
38 cord lock
40 snap hook Description—FIGS. 1 and 2

Figure 1B:
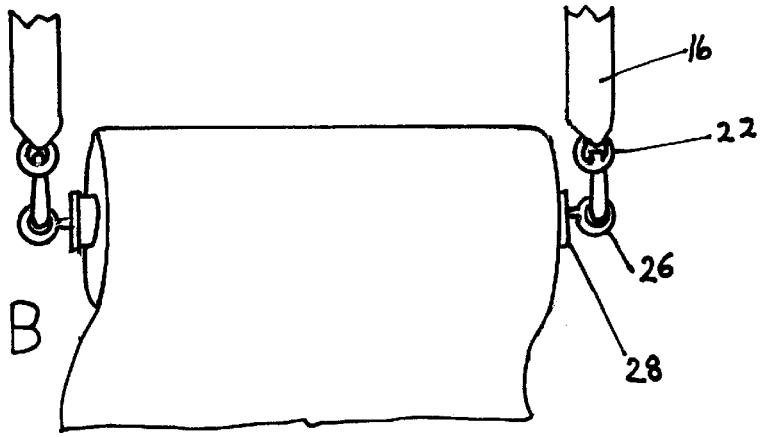
Figure 2A:
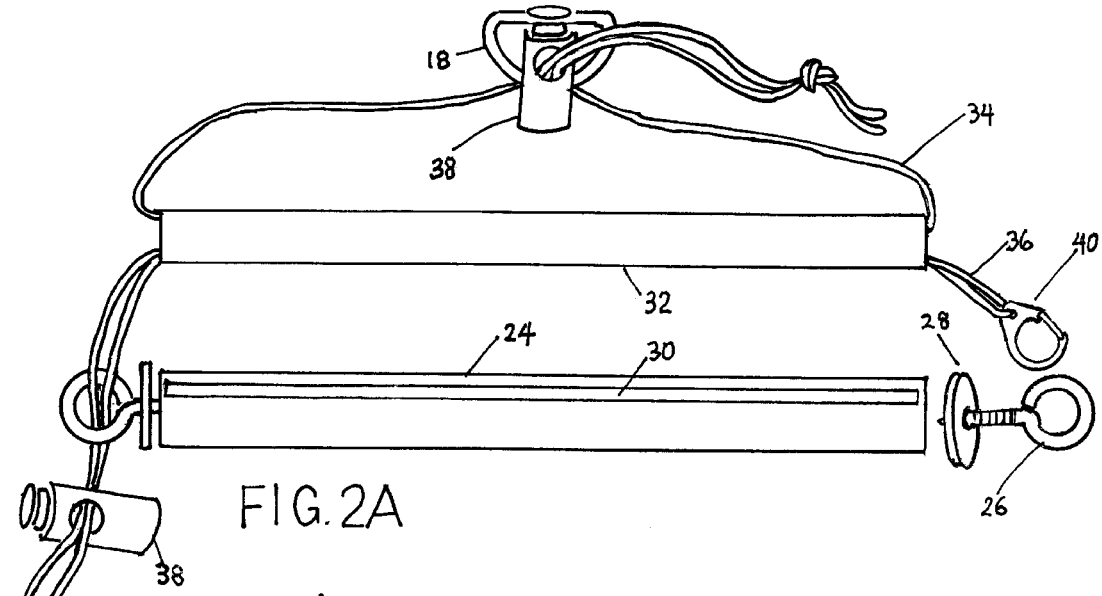
FIGS. 2A to 2B show various aspects of the tension device configuration and its parts.
Figure 2B:
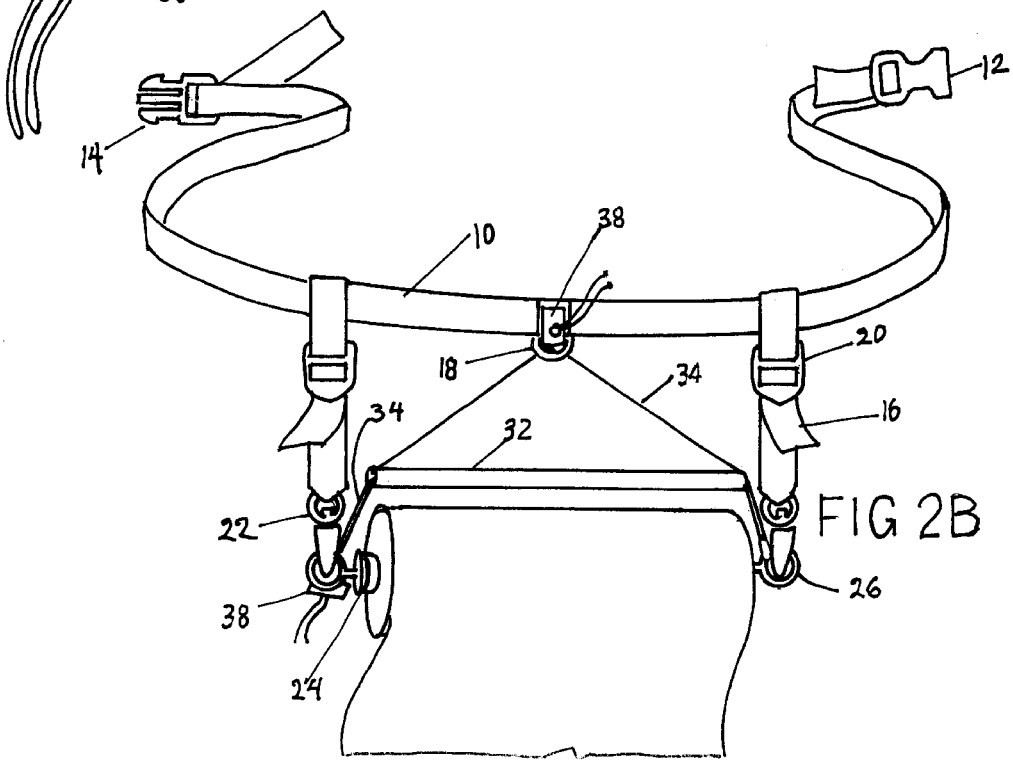

A typical embodiment of the paper towel harness of the present invention is illustrated in FIGS. 1A and 1B (basic harness strap assembly with belt, belt appendages and a paper towel support system shown as a dowel), and FIG. 2A (harness tension mechanism). FIG. 2B illustrates a complete harness device loaded with paper towels. The belt strap 10 and belt appendage straps 16 consist of lengths of web strapping. The belt strap 10 is cut from approximately 36 inches of web strapping. One end of the belt strap 10 runs through a quick release buckle 12 and the strap is sewn back onto itself. The other end of the strap runs through a tension lock 14 side of the quick release buckle 12. Onto the belt strap 10 are sewn two lengths of web strapping 16 which are cut to hang approximately 2⅔ inches. These appendages are sewn onto the belt strap 10 approximately 12 inches apart. A tension lock slider 20 is sewn onto the end of each belt appendage strap 16 which allows both appendages to adjust in length. Run through each of the tension locks 20 is an additional length of web strapping. A bolt snap 22 is sewn to the bottom end. The belt assembly is ready to receive a detachable dowel 24 system at this point.

A firm foam friction strip 30 is applied to the full length of a wood dowel 24. A fender washer 28 is secured to each end of the dowel 24 with an eye screw 26. The eye screws 26 are both positioned to line up and secure a proper placement of the friction strip 30 on the dowel 24. Because the dowel 24 hangs stationary on the belt appendages, the friction strip 30 is fixed slightly in front, on top of the dowel 24. The position of the friction strip 30 is thus maintained when the dowel 24 is hanging in place, on the harness belt assembly. The friction strip 30 keeps the roll of paper towels from shifting on the dowel 24 in order to retard unraveling. The harness dowel system is attached to the harness belt assembly via the bolt snaps 22 which open to receive the eye screws 26 at each end of the harness dowel system. The harness dowel system may be unsnapped at either end to load a roll of paper towels. A fully loaded harness dowel system is shown in FIG. 1B.

Some paper towels are wound tightly enough to remain stable, without unraveling, on the harness dowel system as presented in FIG. 1B, but some loosely wound, low density towels may become problematical. Because the paper towel roll is worn on the user's person, the motion of the body, when walking or cleaning may cause the towels to loosen and tend to unravel, especially when working out-of-doors or in the wind. To compensate for adverse conditions, my invention includes a detachable harness tension mechanism to keep the paper towel roll stable yet still allow for the perforated towels to be easily dispensed. The harness tension mechanism is illustrated in FIGS. 2A and 2B.

My harness tension mechanism comprises a hollow plastic tension tube 32 which rests on the top of a roll of paper towels which have been loaded onto the wood harness dowel system which has been clipped onto the harness belt assembly as seen in FIG. 2B. A lower length of elasticized shock cord 36 and a separate upper length of elasticized shock cord 34, simultaneously run through the tension tube 32. The upper length of shock cord 34 consists of a single strand that is threaded through the tension tube 32 and runs upwards through a D-ring 18 that is attached to the belt strap 10 where the ends are secured with a cord lock 38 as a means to control the tension of the upper elasticized shock cord 34, which controls the suspension of the tension tube over a roll of paper towels. The lower shock cord 36, length of elasticized shock cord consists of a single length of elasticized shock cord which is doubled over once, and threaded through a snap hook 40. The two loose ends are then threaded through the tension tube 32 and run downwards and threaded through one of the eye screws 26 located on both ends of the dowel 24. One end is run through an eye screw 26 and secured with a cord lock 38. The other folded end bearing the snap hook 40 is run down and clipped to the other eye screw 26 with the attached snap hook 40 which may be unsnapped to disengage the tension mechanism when re-loading the paper towels onto the dowel 24.

The function of the lower shock cord 36 is to maintain a controlled, fluctuating pressure of the tension tube 32 against a paper towel roll. The ends of the lower shock cord 36 are attached to the eye screws 26 of the dowel 24 which causes an inward, downwards pressure towards the paper towels mounted on the dowel 24. As the paper towel roll diminishes, more tension is needed. This is accomplished by unlocking the cord lock 38 pulling the lower elastic elasticized shock cord 34 ends through the cord lock 38 and locking it when the desired tension is attained. Thus, the lower shock cord 36 adjusts the tension tube's pressure upon the circumference of the roll of paper towels as the towels are being dispensed.

Because the lower shock cord 36 pulls the tension tube 32 snugly against the paper towel roll, the pressure of the tension tube 32 discourages the towels from unraveling. The upper shock cord 34 is employed to create an opposing tension to the lower shock cord system 36. The upper elasticized shock cord 34 is attached to the D-ring 18 on the belt 10 contributing an upward pulling on the tension tube, lifting upwards and away from the paper towel roll. The basic function of the upper shock cord 34 is to raise or lower the tension tube 32 as needed, creating just enough resistance against the lower shock cord system 36 to relieve the pressure on the paper towels, thus permitting the towels to be freely dispensed. To disengage the tension mechanism without removing it, the lower shock cord 36 is completely loosened by releasing unlocking the cord lock which releases the pressure of the tension tube 32 on the paper towels, causing the upper shock cord 34 to raise the tension tube 32 upwards and out of the way.

It should be noted and understood that with respect to the embodiments of the present invention, the materials suggested may be modified or substituted to achieve the overall resultant high efficiency. The substitution of materials or dimensions remain within the spirit and scope of the present invention.

Operation—FIG. 3

The manner of using my invention is similar to any mounted paper towel dispenser, however, my invention is a paper towel dispenser that is conveniently worn on the person of the user. No wasted motion walking back and forth from a wall mounted paper towel source. And no wasted energy bending over to retrieve a loose roll of paper towels. One simply reaches down with the hand to tear off the desired amount of towels.

Figure 3A:
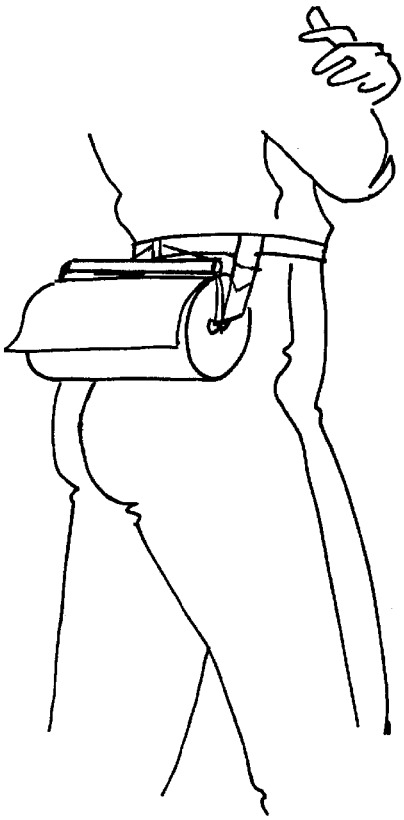
FIGS. 3A to 3C show various ways the harness is worn on the user's person.
Figure 3B:
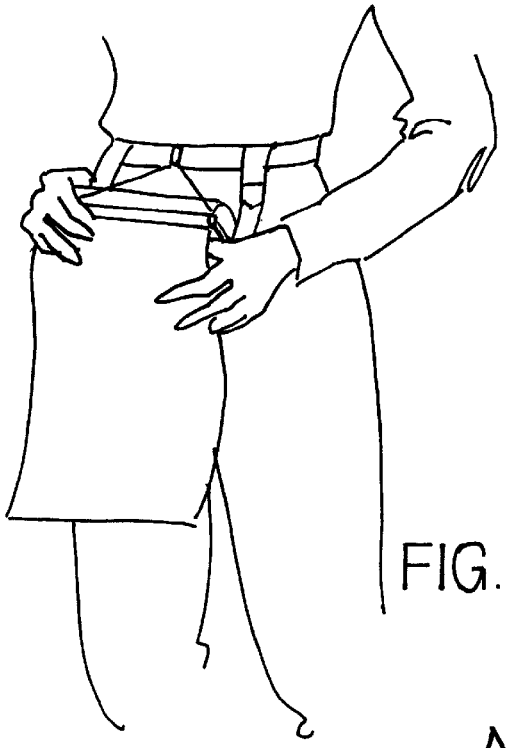
Figure 3C:
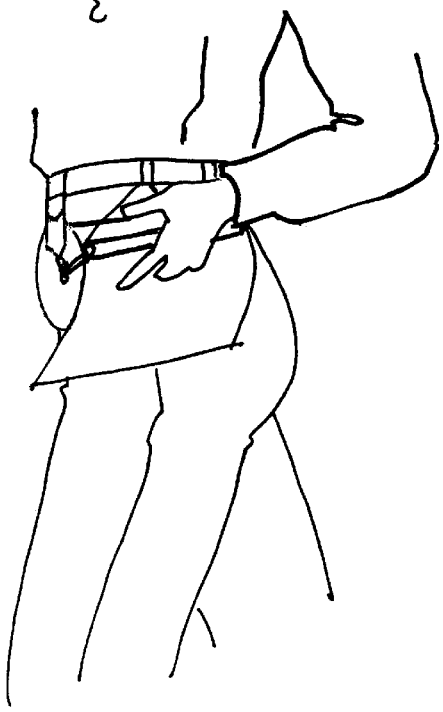

When not in use, the harness may be shifted to the side-back area or backside of the user as seen in FIGS. 3A and 3C. To move the harness to the front (FIG. 3B) or to the side (FIG. 3C), one simply slides the belt around to the position desired. The belt is best worn loosely between the waist and hip for easy maneuvering. When in use, the harness is placed in front or to either side. The harness belt appendages are adjustable in length, allowing either end of the dowel system to be raised or lowered for the comfort and convenience of the user.

The paper towel roll can even be worn vertically to one side when the tension device is not in use by unsnapping one end of the dowel, releasing it to drop down in a vertical position. The loose end may be secured with a toggle pin placed through the eye screw to keep the paper towel roll from slipping off of the dowel. The towels are slightly more prone to unravelling in this mode. But, when working in a small area, it's a viable option.

To re-load the dowel 24 with a new roll of paper towels, one unattaches the dowel system from either belt appendage by unsnapping the bolt snap of the chosen appendage and loads the towels. The harness belt assembly is ambidextrous. But when the tension device mechanism is employed, it must be disengaged by unhooking the snap hook end of the lower shock cord 36 which must also be disconnected, along with the bolt snap of the belt appendage.

Summary, Ramifications and Scope

Accordingly, the reader will see that the paper towel harness of this invention can be used not only by professional cleaning persons, car detailers, painters etc. but it is a convenience and time saver for the average homemaker as well. Furthermore, the paper towel harness has the additional advantages in that:

- it permits the roll of paper towels to be transported to a cleaning area on the person of the user, freeing the hands for other tasks.
- it permits immediate access to a roll of paper towels.
- it permits constant awareness and control of the location of the paper towels.
- it permits the user to switch to other tasks without removing the harness.

Although the description above contains many specifications, these should not be construed as limiting the scope of the invention, but as merely providing illustrations of some of the presently preferred embodiments of this invention. For example, the dowel system, presently comprising a wood dowel 24, friction strip 30, fender washers 28, and eye screws 26, could conceivably be manufactured as a self-contained, one piece unit in plastic, metal or other composition. The tension device mechanism is also open to modifications in materials and hardware, possibly even future automation. The belt assembly lends itself to the possibilities of being modified to be worn over the shoulder or across the chest, dropping the dowel system vertically to the side. The dowel can be worn in a vertical position with modification.

Thus the scope of the invention should be determined by the appended claims and their legal equivalents, rather than the examples given.

I claim:

1. A portable paper towel dispenser adapted for holding a roll of paper towels thereon, the paper towel dispenser comprising:

an adjustable belt;

a pair of belt appendage straps attached to said adjustable belt;

a detachable dowel releasably attached to said belt appendage straps, said detachable dowel adapted for receiving the roll of paper towels thereon;

and a detachable tension device releasably attached to said detachable dowel, said detachable tension device adapted for applying pressure on the roll of paper towels.

2. The portable paper towel dispenser of claim 1 wherein a friction strip is strategically placed on the full length of said detachable dowel as a means to retard unraveling.

3. The portable paper towel dispenser of claim 1 wherein said belt appendage straps are spaced approximately 12 inches apart.

4. The portable belt paper towel dispenser of claim 1 wherein each said belt appendage strap incorporates a tension lock and an additional length of web strapping to adjust the length of each said belt appendage strap.

5. The portable paper towel dispenser of claim 1 wherein a bolt snap is attached to the end of each said belt appendage strap to receive said detachable dowel with eye screws at both ends.

6. The portable paper towel dispenser of claim 1 wherein said detachable tension device comprises opposing upper and lower elastic shock cords which are threaded through a common hollow tension tube as a means to exert pressure against said roll of paper towels.

7. The portable paper towel dispenser of claim 6 wherein said upper elastic cord which runs through said tension tube connects to the belt through a D-ring and fastens with a cord lock.

8. The portable paper towel dispenser of claim 6 wherein said lower elastic cord which runs through said tension tube connects to the dowel through an eye screw on one end and fastens with a cord lock, while the other end of the lower elastic cord is attached to a snap hook to receive an eye screw on the other end of the dowel.

9. A portable paper towel dispenser comprising:

an adjustable belt, a pair of belt appendage straps attached to said adjustable belt, said belt appendage straps support a detachable dowel which bears a roll of paper towels, and a detachable tension device releasably attached to said detachable dowel, said detachable tension device adapted for applying pressure on the roll of paper towels.

10. The portable paper towel dispenser of claim 9 wherein a friction strip is strategically placed on the full length of said detachable dowel as a means to retard unraveling.

11. The portable paper towel dispenser of claim 9 wherein said belt appendage straps are spaced approximately 12 inches apart.

12. The portable belt paper towel dispenser of claim 9 wherein each said belt appendage strap incorporates a tension lock and an additional length of web strapping to adjust the length of each said belt appendage strap.

13. The portable paper towel dispenser of claim 9 wherein a bolt snap is attached to the end of each said belt appendage strap to receive said detachable dowel with eye screws at both ends.

14. The portable paper towel dispenser of claim 9 wherein said detachable tension device comprises opposing upper and lower elastic shock cords which are threaded through a common hollow tension tube as a means to exert pressure against said roll of paper towels.

15. The portable paper towel dispenser of claim 14 wherein said upper elastic cord which runs through said tension tube connects to the belt through a D-ring and fastens with a cord lock.

16. The portable paper towel dispenser of claim 14 wherein said lower elastic cord which runs through said tension tube connects to the dowel through an eye screw on one end and fastens with a cord lock, while the other end of the lower elastic cord is attached to a snap hook to receive an eye screw on the other end of the dowel.

17. The portable paper towel dispenser of claim 9 wherein said belt and said appendage straps lengths of webbing and tension locks support said detachable dowel as a means for transporting said roll of paper towels while said roll of towels is suspended on a user's person.

* * * * *